US009078528B2

(12) United States Patent
Ramdath

(10) Patent No.: US 9,078,528 B2
(45) Date of Patent: Jul. 14, 2015

(54) THERAPEUTIC CUSHION FOR RELIEVING LOWER BACK PAIN

(76) Inventor: Vee Ramdath, Coral springs, FL (US)

( * ) Notice: Subject to any disclaimer, the term of this patent is extended or adjusted under 35 U.S.C. 154(b) by 0 days.

(21) Appl. No.: 13/547,077

(22) Filed: Jul. 12, 2012

(65) Prior Publication Data

US 2014/0115789 A1 May 1, 2014

(51) Int. Cl.
*A47C 17/86* (2006.01)
*A47C 20/02* (2006.01)

(52) U.S. Cl.
CPC ..... *A47C 20/027* (2013.01)

(58) Field of Classification Search
CPC ..... A47G 9/10; A47G 9/1081; A47G 2009/1018; A47G 9/109; A47G 2009/003; A47C 20/027
USPC ..... 5/630, 636, 648, 652
See application file for complete search history.

(56) References Cited

U.S. PATENT DOCUMENTS

| | | | | | |
|---|---|---|---|---|---|
| 2,521,530 | A | * | 9/1950 | McGuffage | 5/630 |
| 2,933,738 | A | * | 4/1960 | Whelan | 5/630 |
| D254,029 | S | | 1/1980 | Barbagallo | |
| 4,424,599 | A | | 1/1984 | Hannouche | |
| 4,431,232 | A | * | 2/1984 | Hannouche | 297/452.32 |
| D276,938 | S | * | 12/1984 | Pedersen | D24/183 |
| 4,796,315 | A | * | 1/1989 | Crew | 5/630 |
| D311,295 | S | | 10/1990 | Roberts | |
| D317,840 | S | | 7/1991 | Jagdat | |
| 5,180,386 | A | * | 1/1993 | Kennedy, Jr. | 606/240 |
| 5,544,377 | A | | 8/1996 | Gostine | |
| D406,486 | S | | 3/1999 | Ogilvie | |
| D410,744 | S | | 6/1999 | Banister | |
| D469,648 | S | | 2/2003 | Meldeau | |
| 6,921,372 | B2 | * | 7/2005 | Shin | 601/134 |
| 7,434,281 | B1 | * | 10/2008 | Holliday et al. | 5/636 |
| D595,527 | S | | 7/2009 | Carter | |
| 2005/0102756 | A1 | * | 5/2005 | Martin | 5/636 |
| 2006/0272095 | A1 | * | 12/2006 | Kornaker | 5/630 |
| 2007/0039102 | A1 | * | 2/2007 | Thompson | 5/655.3 |
| 2008/0115284 | A1 | | 5/2008 | Hiatt | |
| 2009/0222989 | A1 | * | 9/2009 | Dennewald | 5/636 |
| 2011/0061166 | A1 | * | 3/2011 | Liu | 5/636 |
| 2011/0078860 | A1 | * | 4/2011 | Sun | 5/640 |

* cited by examiner

*Primary Examiner* — Timothy D Collins
*Assistant Examiner* — Richard G Davis

(57) ABSTRACT

The present embodiment is a therapeutic cushion for relieving lower back pain. The therapeutic cushion comprises a flat, elongated base, a rounded arc, and two semicircles slopping downwards on both sides of a rounded arc. The flat, elongated base of the therapeutic cushion is positioned on a surface of mattresses, sofas, and seats. When a user utilizes the therapeutic cushion in the supine position, the rounded arc elevates the lumbar spine, thus providing support for the lumbar area. The two semicircles serve to provide support for the sacroiliac joint and upper lumbar area.

18 Claims, 7 Drawing Sheets

THERAPEUTIC CUSHION FOR RELIEVING LOWER BACK PAIN

FIELD

The present application relates to the field of therapeutic equipment. More specifically, the application relates to therapeutic cushions for preventing and relieving chronic or recurring pain associated with the sacroiliac joint as well as with the lumbar spine area.

BACKGROUND

Lower back pain or lumbago is a common musculoskeletal disorder affecting many people at some point in their lives. Lower back pain may be classified by the duration of symptoms as acute, sub acute, and chronic.

Among numerous possible causes of back pain, the most common is back muscle strain or injury. However, there can be other causes, such as damage or injury to spinal nerves, spinal joints, or discs. Additionally, when deviations in posture are present, muscular tightness and pain issues can obstruct normal, pain-free positioning and movement. To help the body attain and maintain optimal body alignment, assistive devices such as therapeutic cushions are utilized.

Besides the most common form of therapeutic cushion that is placed in a chair to support the hips and evenly distribute weight while sitting, there are also lumbar or lower back cushions that help maintain the normal curvature of the lower back area and can aid in relieving some types of back pain, including stress-related symptoms commonly caused by slouching. However, the available variety of lower back cushions cannot guarantee success for each user. Consequently, an individualized approach is required for each user to provide effective support for the lumbar spine. Therefore, it would be useful to have lower back cushions with different levels of density and inflatable chambers allowing for self-regulating and controlling a shape of a cushion, and thus adjusting the cushion for an individual user.

SUMMARY

Provided is a therapeutic cushion for alleviating lower back pain and minimizing muscle tension.

The therapeutic cushion has a specific arc-shaped form. The therapeutic support of the small of the back is performed by a rounded arc that elevates the lumbar spine area. The two semicircles sloping down from a rounded arc are constructed to support the sacroiliac joint and the upper lumbar area. The present embodiment may be utilized either in a supine or sedentary position on a surface of mattresses, sofas, and chairs.

In order to accommodate the therapeutic cushion for various sized individuals without sacrificing the proper positioning of the back-engaging portion, the therapeutic cushion may be constructed of a material of different densities, or it may be provided with one or more inflatable chambers that may include an inflator to subsequently inflate and deflate the chambers. This would allow controlling the pressure of different parts of the therapeutic cushion on some areas of the lumbar spine.

BRIEF DESCRIPTION OF DRAWINGS

Embodiments are illustrated by way of example and not limitation in the figures of the accompanying drawings, in which like references indicate similar elements and in which.

DETAILED DESCRIPTION

The present embodiment is a therapeutic cushion that provides support for the lower back to alleviate and minimize tension. The therapeutic cushion may be placed between a surface and the lower back of a user. These surfaces may include mattresses, sofas, and chairs. The present embodiment may be an arc-shaped cushion with two semicircles sloping downwards on both sides of a rounded arc. The cushion has a planar bottom surface and is constructed of a resilient and flexible material.

When applying the cushion, the protruded arc-shaped portion provides support for the small of the back section of the spine, thus relieving the tension in this area.

Materials for construction of the therapeutic cushion may include urethane foam material, which is formed to a specific shape in a mold, cut to shape from a bigger piece of foam, or is constructed of smaller pieces of foam fastened to each other with adhesive. The shape may be filled with shredded foam or soft material, or with both foam and soft material in combination.

In some embodiments, the therapeutic cushion may be constructed of waterproof, water-repellant material coated with a protective anti-microbial layer. Materials for construction of the therapeutic cushion may also include thermoregulating material that, on the one hand, has a warming effect, but at the same time absorbs excess heat from the body when body temperature exceeds a certain degree, thus providing a possibility to use the cushion both in winter and on hot summer days.

In some embodiments, the therapeutic cushion may also be constructed of safe, non-toxic material, such as natural latex, which is known for its inherently hypo-allergenic, heat regulating, anti-microbial, and dust mite resistant properties.

Different densities of foam may be employed to produce a desired shape of the cushion and adjust it to individual lower back contours.

Other embodiments include providing the cushion with one or more inflatable chambers for temporarily removing or reducing the support to thereby cyclically and temporarily relieve pressure on different areas of lower back.

The present embodiment will be better understood on the basis of figures listed below.

Figure 1:
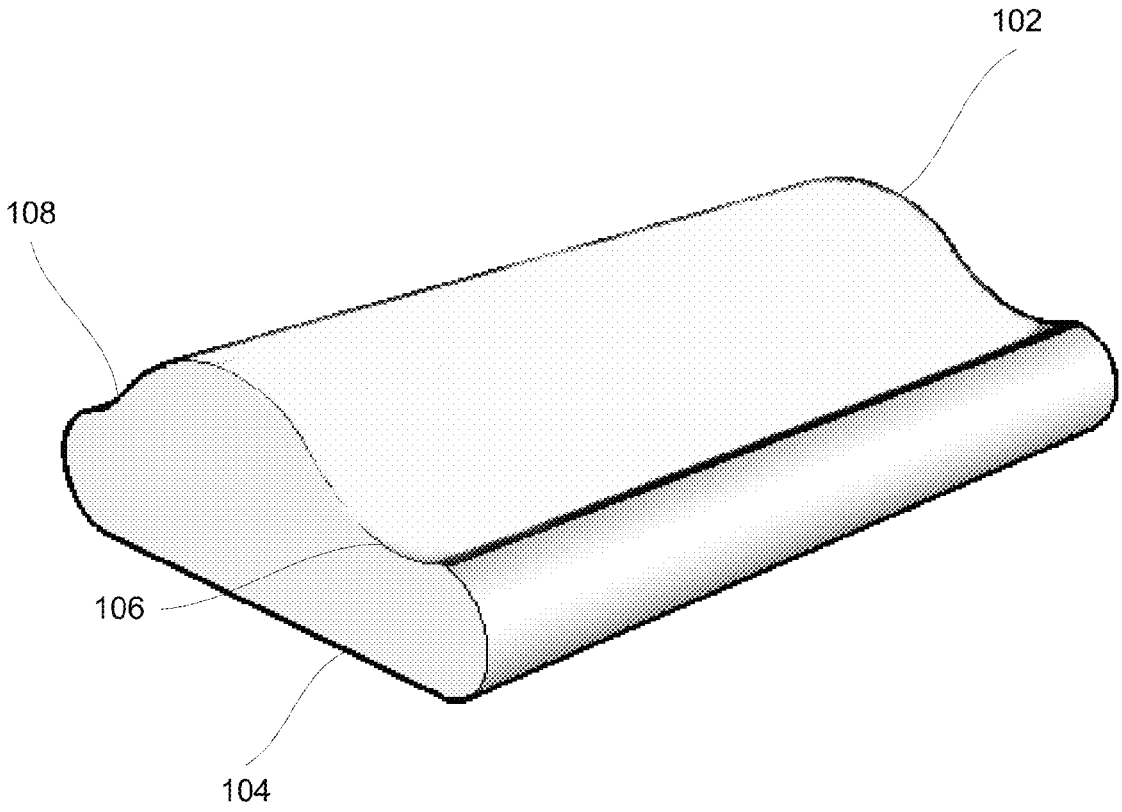
FIG. 1 is a schematic representation of a perspective view of a therapeutic cushion, in accordance with an example embodiment.

FIG. 1 illustrates a schematic representation of a perspective view of a therapeutic cushion constructed of a resilient material of different densities. A total height of the therapeutic cushion may be approximately 2 to 6 inches. The present embodiment may have a flat, elongated base 104, two semicircles on both sides: a bigger semicircle 106 and a smaller semicircle 108, and a rounded arc 102 providing support for the lower back. The therapeutic cushion may be constructed of a resilient foam material (for example, urethane foam). A shape of the therapeutic cushion may be filled either with shredded foam or pliable material such as, for example, fiber. The filling of the shape may alternatively comprise both shredded foam and pliable material.

Figure 2:
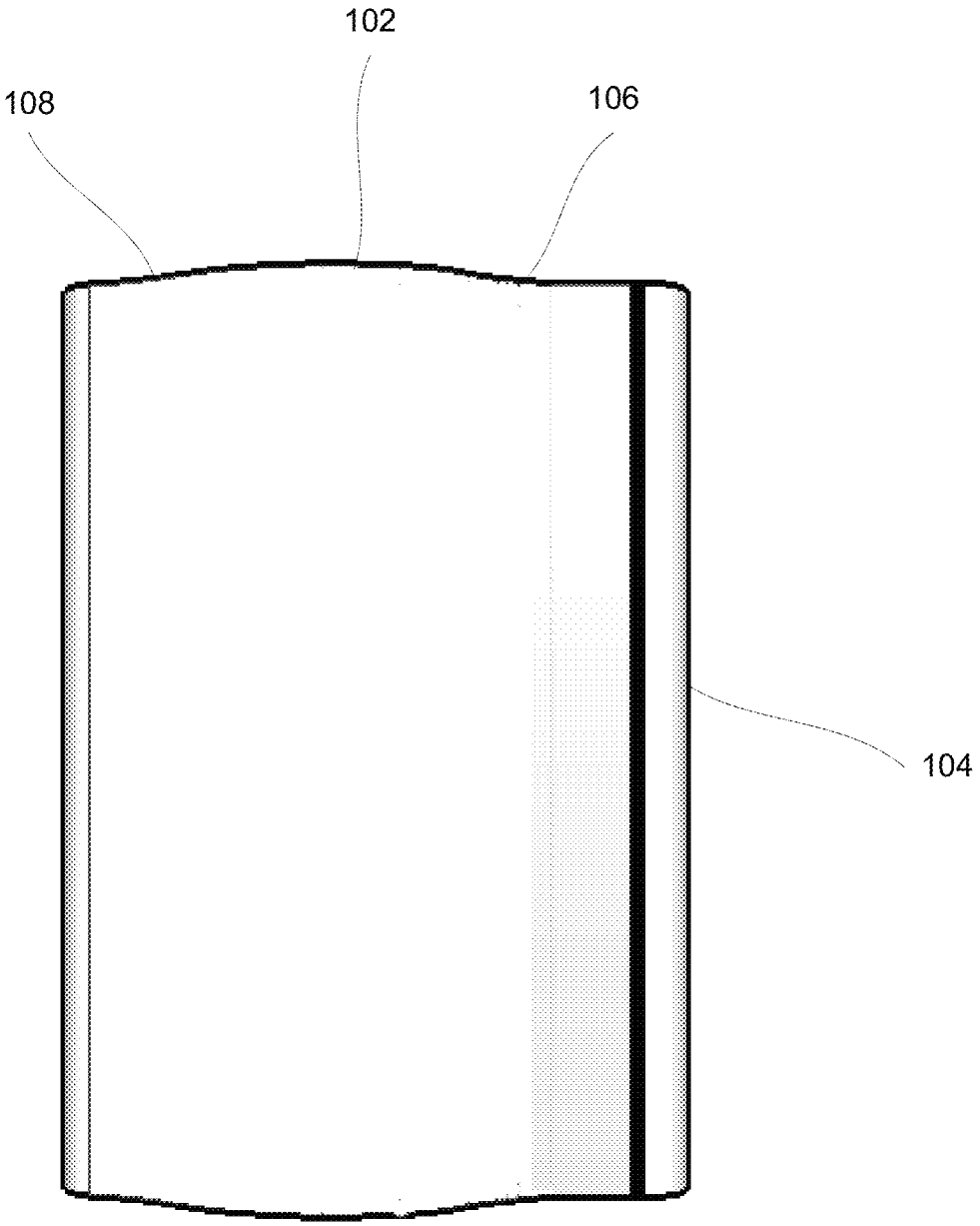
FIG. 2 illustrates a schematic representation of a top view of a therapeutic cushion, in accordance with an example embodiment.

FIG. 2 demonstrates a schematic representation of a top view of a therapeutic cushion with a flat, elongated base 104 that can be placed on mattresses, sofas, and seats. The flat, elongated base 104 may be constructed of a resilient and flexible material. FIG. 2 also demonstrates a top view of two semicircles sloping down from a rounded arc 102 on both sides: a smaller semicircle 108 on the left and a bigger semicircle 106 on the right.

Figure 3:
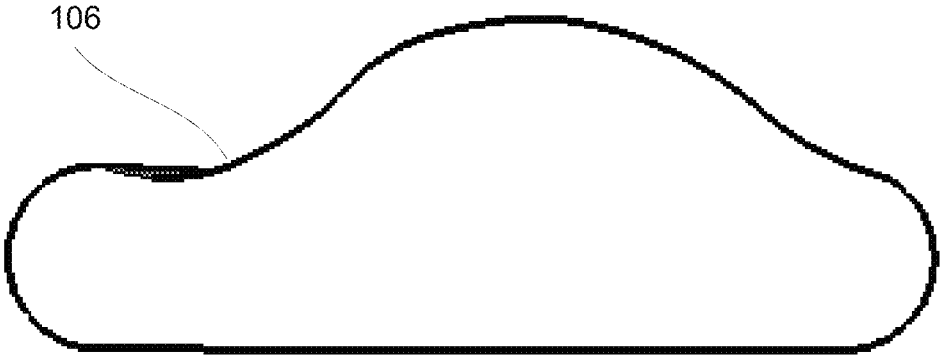
FIG. 3 is a cross-section view of a therapeutic cushion from the left side, in accordance with an example embodiment.

FIG. 3 is a cross-sectional view of a therapeutic cushion from the left side. A bigger semicircle 106 of the therapeutic cushion may be used to support the sacroiliac joint either in the supine or sedentary position.

Figure 4:
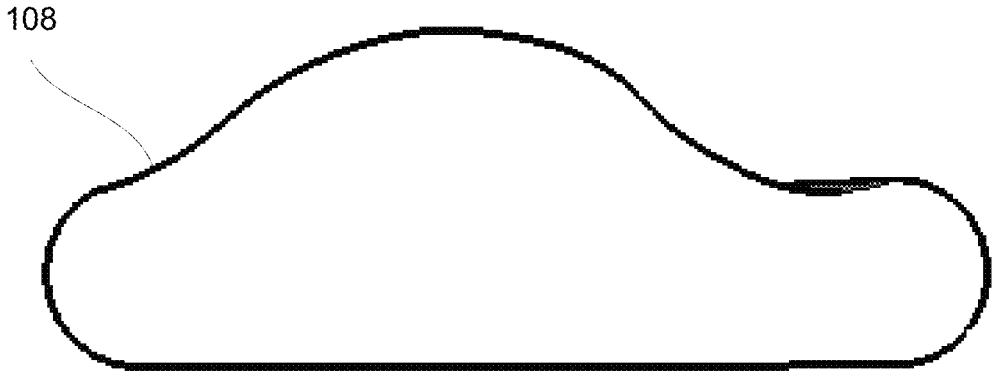
FIG. 4 is a cross-section view of a therapeutic cushion from the right side, in accordance with an example embodiment.

FIG. 4 is a cross-sectional view of a therapeutic cushion from the right side. A smaller semicircle 108 of the therapeutic cushion may be used to support the upper lumbar area either in the supine or sedentary position.

Figure 5:
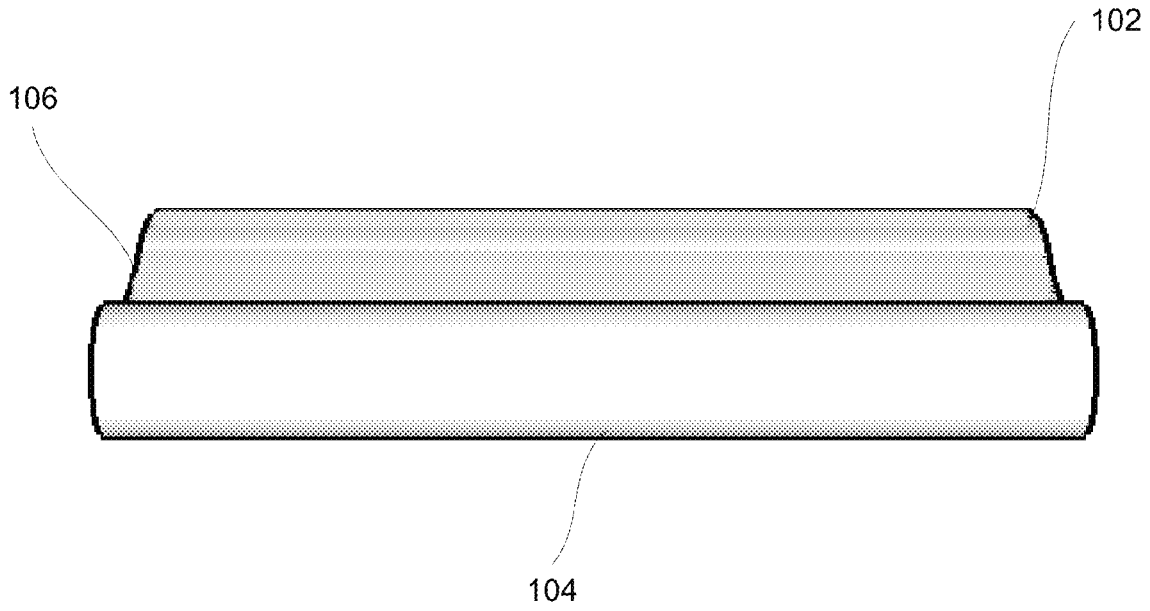
FIG. 5 illustrates a front view of a therapeutic cushion, in accordance with an example embodiment.

FIG. 5 illustrates a schematic representation of a front view of a therapeutic cushion. A rounded arc 102 is elevated above a flat, elongated base 104. The front view also demonstrates a bigger semicircle 106 for support of the sacro-iliac joint.

Figure 6:
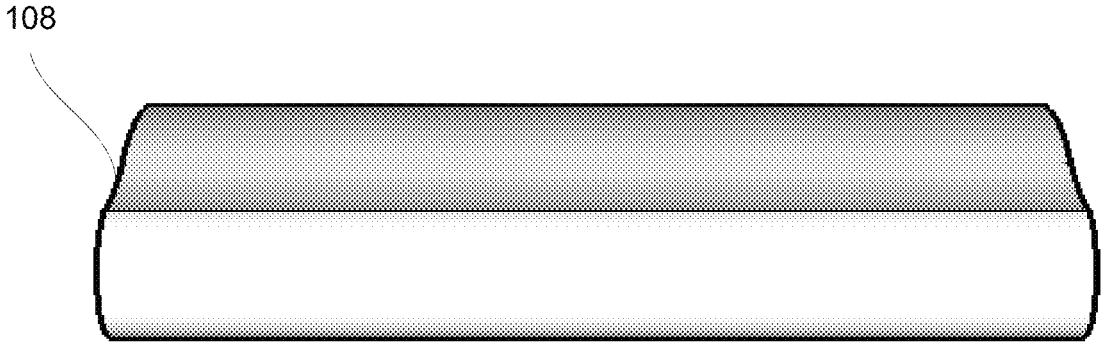
FIG. 6 illustrates a back view of a therapeutic cushion, in accordance with an example embodiment.

FIG. 6 illustrates a schematic representation of a back view of a therapeutic cushion. The back view demonstrates a smaller semicircle 108 used for support of the upper lumbar area.

Figure 7:
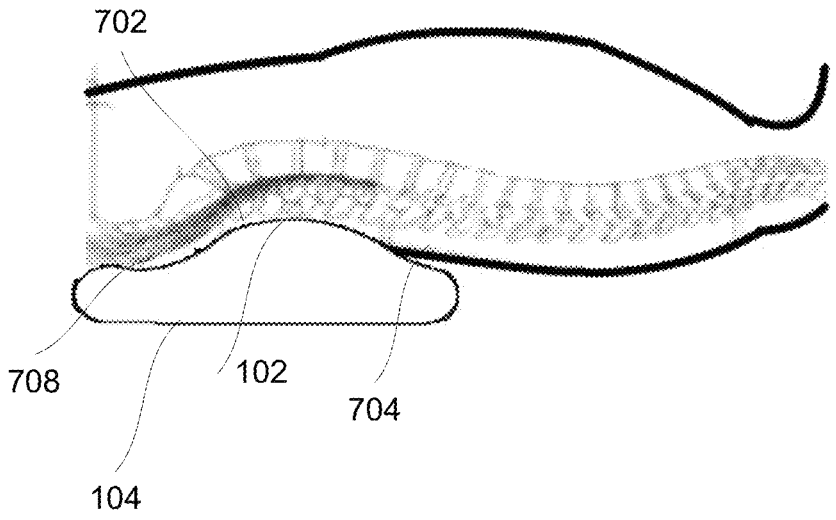
FIG. 7 demonstrates utilization of the therapeutic cushion in the supine position, in accordance with an example embodiment.

FIG. 7 illustrates utilization of a therapeutic cushion in the supine position. The present embodiment is illustrated in cross section from the left side. The therapeutic cushion is positioned on a surface with a flat, elongated base 104. A user lies down on the therapeutic cushion so that the lumbar spine 702 rests on a rounded arc 102. As a result, the lumbar spine 702 gets elevated, while the sacroiliac joint 708 is below the level of the upper lumbar area 704.

The therapeutic cushion may be utilized in the same way while sitting on a sofa, in a chair, or in any other seat. In order to utilize the therapeutic cushion in the most efficient way, it may be constructed with materials of different densities or provided with inflatable chambers to adjust the therapeutic cushion to an individual physique.

What is claimed is:

1. A therapeutic cushion for relieving lower back tension, the cushion comprising:

a lateral cross-section defined by a flat bottom, opposite first and second convex curved ends, and an S-shaped top having an absolute maximum offset toward the second convex curved end, creating both a longer side and a shorter side of the absolute maximum, a first concave depression on the longer side of the absolute maximum, and a second concave depression on the shorter side of said absolute maximum, wherein the minimum height created by the second concave depression is no less than the minimum height created by the first concave depression, wherein a hump is defined as the portion of the S-shaped top which is between the point of minimum height created by the first concave depression and the point of minimum height created by the second concave depression, and said hump covers no less than half of the total length of the cushion, wherein said cross-section extends continuously between opposite sides of said cushion, thereby defining a curved top surface and a flat base, wherein the curved top surface is configured to provide lumbar support when a user positions their sacroiliac joint proximate the first concave depression and positions their upper lumbar area proximate the second concave depression.

2. The therapeutic cushion of claim 1, wherein the flat base is resilient and flexible.

3. The therapeutic cushion of claim 1, further comprising one or more inflatable chambers embedded therein.

4. The therapeutic cushion of claim 1, wherein the cushion is constructed of a resilient foam material of different densities.

5. The therapeutic cushion of claim 4, wherein the resilient foam material for the therapeutic cushion is constructed of smaller pieces of foam fastened to each other with adhesive.

6. The therapeutic cushion of claim 4, wherein materials for construction of the cushion include a urethane foam material, which is formed to a specific shape in a mold, and cut to shape from a bigger piece of foam.

7. The therapeutic cushion of claim 6, wherein the shape is filled with shredded foam.

8. The therapeutic cushion of claim 6, wherein the shape is filled with a soft, pliable material.

9. The therapeutic cushion of claim 8, wherein the soft, pliable material is a fibrous material.

10. The therapeutic cushion of claim 8, wherein the shape is filled by a combination of methods: both with shredded foam and soft, pliable material.

11. The therapeutic cushion of claim 8, wherein the material is coated with an anti-microbial layer.

12. The therapeutic cushion of claim 1, wherein the therapeutic cushion is constructed of a water resistant material.

13. The therapeutic cushion of claim 1, wherein the therapeutic cushion is constructed of thermoregulating material.

14. The therapeutic cushion of claim 1, wherein the therapeutic cushion is constructed of non-allergenic, non-toxic foam material.

15. The therapeutic cushion of claim 14, wherein the non-allergenic, non-toxic foam material is natural latex foam.

16. The therapeutic cushion of claim 1, wherein said opposite sides of said cushion are substantially parallel.

17. The therapeutic cushion of claim 1, wherein said opposite sides are substantially perpendicular to said base.

18. The therapeutic cushion of claim 1, wherein said cushion is a single molded piece.

* * * * *